United States Patent [19]

Ushijima

[11] 4,400,252

[45] Aug. 23, 1983

[54] METHOD OF MANUFACTURING METAL DECORATIVE PANEL HAVING COLORED DEPRESSIONS

[75] Inventor: Hideru Ushijima, Youkaichi, Japan

[73] Assignee: Toppan Printing Co., Ltd., Tokyo, Japan

[21] Appl. No.: 282,648

[22] Filed: Jul. 13, 1981

Related U.S. Application Data

[63] Continuation-in-part of Ser. No. 145,970, May 2, 1980, abandoned, which is a continuation of Ser. No. 22,111, Mar. 20, 1979, abandoned.

[51] Int. Cl.[3] ..... C25D 13/20; C25D 13/06

[52] U.S. Cl. ..... 204/181 R; 204/181; 204/33; 204/35 R; 204/38 E; 204/181 C

[58] Field of Search ..... 204/181 R, 181 C, 18.1, 204/32 R, 35 R, 33, 34, 38 E

[56] References Cited

U.S. PATENT DOCUMENTS

| | | | |
|---|---|---|---|
| 3,202,588 | 8/1965 | Fromson | 204/18.1 |
| 4,121,979 | 10/1978 | Wake | 204/34 |
| 4,201,821 | 12/1978 | Fromson et al. | 204/18.1 |
| 4,210,695 | 7/1980 | Hirono et al. | 204/38 |

FOREIGN PATENT DOCUMENTS

| | | | |
|---|---|---|---|
| 53-11847 | 2/1978 | Japan | 204/33 |

*Primary Examiner*—Howard S. Williams
*Attorney, Agent, or Firm*—Bacon & Thomas

[57] ABSTRACT

A metal decorative panel, wherein concave portions are etched with a desired pattern in the surface of a metal plate; a photosensitive synthetic resin layer is electrically deposited on the surface of said concave portions; a desired pattern is transcribed by sublimation on said electrically deposited synthetic resin layer, using sublimable dyes, and which displays high abrasion resistance and weatherability, and a beautiful decorative effect due to a synthetic combination of the partly colored portions of the surface of the metal plate and the exposed glossy portions thereof.

3 Claims, 8 Drawing Figures

METHOD OF MANUFACTURING METAL DECORATIVE PANEL HAVING COLORED DEPRESSIONS

CROSS-REFERENCE TO RELATED APPLICATION

This application is a continuation-in-part of my application Ser. No. 145,970, filed May 2, 1980, which in turn is a continuation of my application Ser. No. 22,111, filed Mar. 20, 1979 and both now abandoned.

BACKGROUND OF THE INVENTION

This invention relates to the method of making a colored metal decorative panel, and more particularly to a partly colored decorative panel which is prepared by impressing sublimable dyes by sublimation transcription on the surface of a synthetic resin layer electrically deposited on the surface of etched concave portions of a metal plate.

A known method of coloring a metal plate, particularly, a stainless steel plate is based on oxidation or ordinary printing. Oxidation coloring has the merit that since a metal surface is colored by oxidation, the gloss of a metal plate itself can be favorably utilized, but is accompanied with the drawbacks that a pattern layer produced has a low resistance to acids. Since coloration is applied on convex surface portions or those surface portions which are flush with the other surface portions which should not be colored, a picture layer produced is likely to be faded away by contact with external objects or by being abraded thereby. On the other hand, coloration of a metal surface by ordinary printing has the drawback that dyes used often have a low adhesivity to a metal, and prove indurable. Where dyes are applied only in the concave surface portions of a metal plate, then the dyes will remain more durable. However, the ordinary painting or printing method presents difficulties in applying dyes only to the concave surface portions of a metal plate in accurate conformity thereto.

Another metal surface-coloring method disclosed in Japanese patent publication No. 51734, 1972 comprises the steps of first coating a synthetic resin layer on, for example, a metal plate and then coloring said resin layer. This method still had the drawbacks that a synthetic resin layer was found to have low adhesivity to a metal plate; and since the synthetic resin layer was deposited all over the surface of a metal plate, it was impossible to effectively utilize the gloss of metal plate, imposing great limitations on the designing of a picture pattern.

SUMMARY OF THE INVENTION

This invention has been accomplished in consideration of the drawbacks accompanying the known metal surface-coloring methods, and is intended to provide a method for making a colored metal decorative panel, in which a durable multicolor picture pattern is impressed on the surface of a metal plate in precise conformity to a desired design; dyes used have high adhesivity to a metal plate; and the gloss of said metal plate is effectively utilized to improve the decorative effect of the colored metal panel.

To attain the above-mentioned object, this invention provides a method for making a partly colored metal decorative panel, in which concave portions are formed by pattern etching in a desired portions of the surface of a metal plate; for example, an electrically deposited synthetic resin layer is filled in said concave portions; and the electrically deposited synthetic resin layer is colored by sublimable dyes to indicate a desired pattern.

BRIEF DESCRIPTION OF THE DRAWINGS

This invention can be more fully understood from the following detailed description when taken in conjunction with the accompanying drawings, in which.

DETAILED DESCRIPTION OF THE PREFERRED EMBODIMENTS

Figure 1:
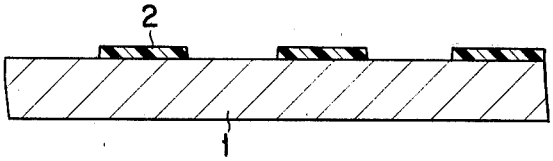
FIGS. 1 to 5 illustrate the sequential steps of manufacturing a colored metal decorative panel according to one embodiment of this invention.
Figure 2:
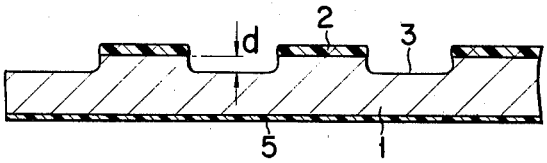

Referring to FIG. 1, a metal plate 1 is made of a material selected from a group consisting of, for example, iron, aluminum, stainless steel, copper, alloys thereof, any other metals and alloys thereof. A resist layer 2 deposited on the metal plate 1 well serves the purpose, if it is acid-resistant and electrically nonconducting. More concretely, the resist layer 2 is formed of, for example, ink, paint, photosensitive synthetic resin, varnish or lacquer. The resist layer 2 is patterned, for example, by first applying a photosensitive synthetic resin layer all over the surface of the metal plate 1, exposing said resist layer to light through a patterned mask, and removing the unilluminated, unhardened portions of said resist layer 2 by a solvent. The patterning of the resist layer 2 may be effected by any other printing process, for example, the screen printing process. General practice is to deposit an electrically insulating patterned resist layer 2 on the surface of the metal plate 1 by the masking process.

The surface of the metal plate 1 on which the resist layer 2 is laid is etched to a proper depth "d" in the succeeding step to provide concave portions 3. Reference numeral 5 denotes a protective layer for preventing the backside of the metal plate from being corroded by an etchant. Etching may be carried out by chemical etching, electrolytic etching, or a dry process such as that based on sputtering or plasma. Etching is generally undertaken advisably to a depth "d" of 20 to 50 microns. If desired, however, etching can be proceeded to any other depth.

The metal plate 1 whose surface is provided with concave portions 3 is dipped in a tank holding an aqueous solution containing a paint for electric deposition at a relatively low concentration of, for example, 5 to 10% by weight, with the metal plate 1 used as an anode or a cathode. What calls for attention is that the resist layer 2 is still attached to the surface of the metal plate 1. Under this condition, current is let to pass across another pair of electrodes to electrically deposit out a synthetic resin layer 4 uniformly only in the concave portions 3 of the metal plate. 1. A paint for electric deposition used with this invention is that type which is based on, for example, epoxy resins, phenol alkyd resins, amino alkyd resins, and acrylic resins, and, when dipped in water, is charged with a negative potential by a large number of amino radicals contained in the molecules of said resin, thereby providing a colloidal dispersion. Concretely, said electric deposition type paint includes, for example, paints manufactured by Shinto Paint Co., Ltd. under the trademark "S-VIA ED Paint;" manufactured by Honny Chemicals Co., Ltd. under the trademark "Honnytone;" and manufactured by Kansai Paint Co., Ltd. under the trademark "Elecron." It is possible for the paint to contain pigments in addition to the resins mentioned above. A fine powder of pigment bears a negative or positive interfacial electrokinetic potential in water and, thus, is capable of migration toward an electrically conductive plane like the resins contained in the paint for electrodeposition. In many cases, the pigment is attached to the resin and the resin bearing the pigment is fixed to the depression of the metal plate. When it comes to the resin layer 4 formed by electrodeposition of a paint containing, for example, a white pigment together with the resin, the resin layer 4 itself is colored white and, thus, is made more opaque. As a result, the color of the substrate metal is shielded by the resin layer 4. This is advantageous in the subsequent step of dyeing the resin layer 4 with a sublimable dye. Specifically, the dye is enabled to exhibit its color clearly because the color of the substrate metal is shielded by the opaque resin layer.

There will now be described a process by which a paint is electrically deposited to the concave portions 3 of the surface of the metal plate 1. Where a potential is applied to a negative or a positive colloidal dispersion of a paint, then the fine particles of the colloidal dispersion are shifted toward the positive or negative electrode, which is the metal plate 1 (electric migration). When reaching the metal plate 1, the fine particles of the colloidal dispersion are discharged to lose electric energy. As a result, the particles are rendered insoluble in water and collected on the surface of the concave portions 3. Further, where an electric field is applied, the water content of the deposited paint layer is drawn off, namely, the so-called dehydration phenomenon takes place.

Figure 3:
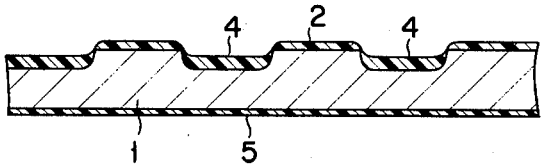

Voltage impressed across the latter paired electrodes should preferably range between 30 and 80 volts. Power supply for 1 to 2 minutes is often sufficient, though the duration of power supply may vary with the thickness of a paint layer 4 to be deposited. According to the method of this invention, a paint layer 4 is deposited on a rough freshly etched surface, and displays an extremely high adhesivity to the metal plate 1. After electric deposition of the paint layer 4 is completed, the metal plate 1 now brought to the state of FIG. 3 is thermally dried, thereby effecting the permanent fixation of the paint layer 4 and consequently increasing its durability.

Figure 4:
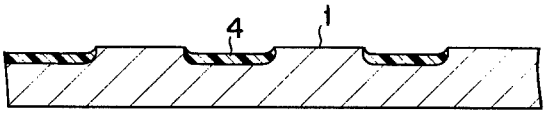
Figure 5:
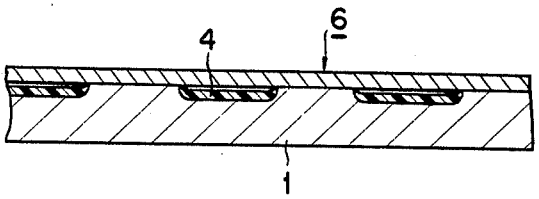

In the succeeding step, the resist layer 2 is washed off, for example, by a solvent, as shown in FIG. 4. The surface of the metal plate 1 treated as mentioned above consists of the exposed glossy surface of the metal and the electrically deposited paint layer 4. Then, as shown in FIG. 5, a sublimation transfer sheet 6 is put on the surface of the metal plate 1. When said transfer sheet 6 is tightly pressed against the surface of the metal plate 1 at a temperature of, for example, 150° to 200° C. and thereafter taken off, then the pattern depicted on the transfer sheet 6 is transcribed by sublimation only on the electrically deposited synthetic resin paint layer 4. The transfer sheet 6 for sublimation is previously impressed with a desired pattern by an ink composition containing a sublimable, vaporizable or thermally migratory paint (hereinafter referred to as "a sublimable dye"). The sublimable dye includes, for example, a dispersion dye, cation dye, and oil-soluble dye, or concretely, Diacelliton pink B and Diacelliton violet 3R manufactured by Mitsubishi Kasei Co., Ltd., Japan; Sumikaron yellow E-G manufactured by Sumitomo Chemical Co., Ltd., Japan; Aizen Cathilon yellow 3GLH and Aizen Cathilon red 6BF manufactured by Hodogaya Chemical Co., Ltd., Japan; and Plastic violet 8840 manufactured by Arimoto Chemical Co., Ltd., Japan.

The sublimation transcription process enables a pattern to be transcribed from the sublimation transfer sheet to the surface of an object of transcription without difficulties, even where fine irregularities are formed on said surface. In the case of this invention, where the surface of the electrically deposited synthetic resin paint layer 4 is slightly depressed below the top surface of the metal plate 1, the sublimation transcription process favorably ensures the transcription of a beautiful pattern without failures.

Figure 6:
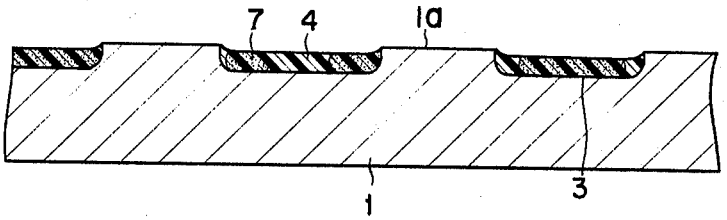
FIG. 6 is an enlarged fractional sectional view of the colored metal decorative panel of FIGS. 1 to 5.
Figure 7:
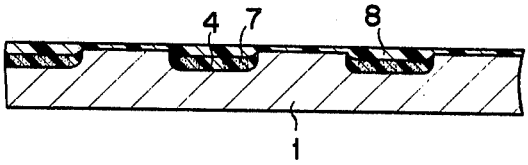
FIG. 7 is an enlarged fractional sectional view of a colored metal decorative panel according to another embodiment of the invention.

FIG. 6 illustrates a colored metal decorative panel made by this invention. A sublimable dye 7 indicated in dots is not only spread over the surface of the electrically deposited synthetic resin paint layer 4, but also is carried into the interior thereof, thereby truthfully reproducing a pattern previously printed on the transfer sheet 6. The nonetched plane 1*a* of the surface of the metal plate 1 constitutes a glossy region. The synthetic resin paint layer 4 electrically deposited on the surface of the etched concave portions 3 of the surface of the metal plate 1 has a smaller thickness than the depth "d" of said concave portions 3. Consequently, the nonetched plane 1*a*, that is, the glossy region is raised above the top plane of the electrically deposited synthetic resin paint layer 4. The colored metal decorative panel of this invention can be regarded to have been substantially finished, when brought to the condition of FIG. 6. However, it may be practically advisable to mount, as shown in FIG. 7, a transparent synthetic resin film 8 on the finished surface of the metal plate 1. Application of said transparent film 8 can improve the resistance to water and chemicals and weatherability of the pattern of the colored metal decorative panel.

Figure 8:
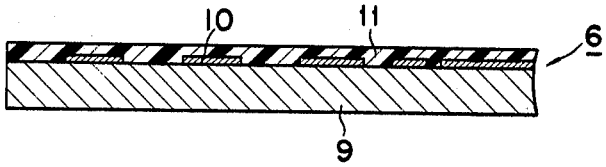
FIG. 8 shows a transfer sheet used for transcription of sublimable dyes during the manufacture of the subject colored metal decorative panel.

Now description is further given a sublimation transfer sheet used during the manufacture of a colored metal decorative panel embodying this invention. The base sheet 9 is generally formed, as shown in FIG. 8, of any of the various kinds of paper (high grade paper, medium grade paper, low grade paper, art paper, cost paper, gravure paper, Japanese paper, etc.). However, the base sheet 9 can be made of unwoven fabric, film, or metal foil. An ink layer 10 for transcription is prepared by mixing a sublimable dye as a coloring material, binder, various auxiliary agents and solvents. A desired pattern is impressed on the base sheet 9 by the above-mentioned ink composition, using a suitable printing process, for example, the gravure printing process, or screen printing process. The binder used is chosen to be the type which is little likely to be colored by a sublimable dye and is so thermally stable as to be saved from softening even at a sufficiently high temperature for sublimation of a sublimable dye. During the transcription step, therefore, only the sublimable dye is transcribed on the electrically deposited synthetic resin layer 4 as shown in FIG. 6. As indicated in FIG. 8, an overcoat 11 is mounted on the transcription ink layer 10. An overcoat 11 is prepared from, for example, silicone resin, polyvinyl alcohol or polyvinyl butylal which is not colored by a sublimable dye. The function of the overcoat 11 is to suppress the occurrence of blocking when a plurality of transfer sheets are stored in a superimposed state, and, after transcription of a sublimable dye, facilitate the quick peeling of a transfer sheet from an object of transcription, thereby preventing erroneous transcription such as double transcription. However, the overcoat 11 is not always required. The transfer sheet can fully perform its fundamental function, provided it is formed of the base sheet 9 and transcription ink layer 10.

This invention will be more fully understood by reference to the examples which follow. It will be noted, however, that this invention is not limited in any way by these examples.

EXAMPLE 1

A layer of photosensitive synthetic resin was uniformly deposited on a stainless steel plate having a thickness of 0.5 mm. Light was projected on said resin layer through a negative film provided with a desired light-obstructing pattern, followed by development, thereby forming a patterned electrically nonconductive resist layer. Thereafter, the exposed portions of the surface of the stainless steel plate were spray-etched by a solution of ferric chloride having a Baume concentration of 40° at a temperature of 45° C. to a depth of 30 microns to provide concave portions. The stainless steel thus treated was dipped in water of a tank in which 9% of the aforesaid "Honnytone" acrylic resin paint for electric deposition was dissolved. DC electric power was supplied at a voltage of 50 V for one minute with the stainless steel plate used as an anode. At this time, water in the tank was maintained at a temperature of 25° C. After the power supply of one minute, the stainless steel plate was taken out, and washed with sprayed water to wash off the excess portions of said "Honnytone" acrylic resin paint. Thereafter, the stainless steel plate was dried for 30 minutes in a hot air oven at 180° C. The photosensitive synthetic resin was removed by xylene, providing a film which was transparent only to the etched concave portions.

On the other hand, a desired pattern was impressed on a base sheet by the gravure printing process, using ink compositions prepared from the components listed below, thereby providing a transfer sheet for sublimation transcription on which a transcription ink layer was formed. The transfer sheet was thermally pressed for sublimation transcription against the treated surface of the stainless steel plate for one minute at a temperature of 200° C. and a pressure of 2 kg/cm$^2$.

| | | Parts by weight |
|---|---|---|
| I. | Ink composition (red) | |
| | Sublimable dispersion dye (manufactured by Sumitomo Chemical Co., Ltd., Japan under the trademark "Sumikaron Red E-FBL") | 10 |
| | Ethyl cellulose (binder) | 9 |
| | Isopropyl alcohol (solvent) | 40 |
| | Ethanol (solvent) | 40 |
| | Interface active agent (polyoxyethylene oleil ether) | 1 |
| II. | Ink composition (yellow) | |
| | Sublimable dispersion dye (manufactured by Sumitomo Chemical Co., Ltd., Japan under the trademark "Sumikaron Yellow E-4FG") | 3 |
| | Ethyl cellulose (binder) | 2 |
| | Toluol (solvent) | 10 |
| | Isopropyl alcohol (solvent) | 10 |
| | n-butanol (solvent) | 75 |
| III. | Ink composition (blue) | |
| | Disperse blue No. 73 | 10 |
| | Ethyl cellulose (binder) | 10 |
| | Interface active agent (polyoxyethylene-alkyl aryl ether) | 1 |
| | Isopropyl alcohol (solvent) | 29 |
| | Ethanol (solvent) | 50 |

When the sublimation transfer sheet was taken off the electrically deposited synthetic resin layer after completion of the transcription of the sublimable dye, there was obtained a partly colored metal decorative panel in which the pattern depicted on the sublimation transfer sheet was transcribed on that portion of the surface of the stainless steel plate on which the synthetic resin layer was electrically deposited. This decorative panel displayed a three-dimensional feature due to its beautiful pattern and the gloss of the base body of stainless steel.

This decorative panel displayed an attractive pattern with the glossy plane of the base body of stainless steel exposed.

EXAMPLE 2

A desired pattern was impressed on a copper plate having a thickness of 0.5 mm by the screen printing process, using a screen process printing ink composition (manufactured by Cericol Co., Ltd. under the trademark "PC 922 ink") to provide a resist layer. The exposed portions of the copper plate was etched and a synthetic resin was electrically deposited on said etched portions in the same manner as in Example 1. The resist layer was removed by a 5% caustic soda solution. A sublimation transfer sheet was provided on which a transcription ink layer was formed using an ink composition having the same components as in Example 1. An overcoat having the following compositions was mounted on the transfer sheet as illustrated in FIG. 8 at an amount of 0.5 to 1 g/cm$^2$ by a gravure coating method.

| | Parts by weight |
|---|---|
| Silicone resin (manufactured by Sinetsu Ehcmical Co., Ltd., Japan under the trademark "Shinetsu Silicone KS-770") | 100 |
| Toluol (solvent) | 400 |
| Hardening agent (zinc chloride) | 0.04 |

The transfer sheet was thermally pressed for sublimation transcription against the treated surface of the copper plate for one minute at a temperature of 200° C. and a pressure of 2 kg/cm$^2$, thereby providing a partly colored metal decorative panel displaying the same beautiful pattern as in Example 1.

This invention makes it possible to electrically deposit a photosensitive synthetic resin layer in concave portions, which process was formerly considered difficult for the ordinary printing method, and moreover enables a finished metal decorative panel to display a pattern precisely truthful to an originally designed form. Further according to the invention, the synthetic resin layer is electrically deposited on the rough freshly etched portions of the surface of a metal plate with high adhesivity, thus eliminating the drawback of the conventional process of applying a synthetic resin layer on the surface of a metal plate that the resin layer displays a low adhesivity to the metal plate surface. Since the synthetic resin layer is electrically deposited in the concave portions of the metal plate surface, a pattern transcribed on said resin layer is hardly faded away or abraded by contacting with external objects and, consequently, has such a high durability as ensures a long use. Moreover, a fine complicated pattern can be freely impressed on a synthetic resin layer electrically deposited on the etched concave portions of a metal plate surface by sublimation transcription of a sublimable dye. Therefore, a metal decorative panel embodying this invention displays an excellent solid decorative effect due to a synergetic combination of the exposed glossy portions of the base body of the metal and partly colored portions thereof. The partly colored metal decorative panel of the invention has very wide applications such as decorative metal boards, indoor walls or buildings, aprons of stainless steel bathtubs, stainless steel sinks, outer casings of thermos bottles, and outer cabinet boards of electric appliances.

The content of pigment (such as $BaSO_4$, $TiO_2$, $CaCO_3$) to be included in a paint for electrodeposition ranges 5 to 50% by weight base on the weight of the paint.

What is claimed is:

1. A method of manufacturing a metal decorative panel having colored depressions, which comprises forming a pattern of electrically nonconducting resist layer on a surface of a metal panel, partially exposing the surface of the metal panel; etching the exposed metal surface to a prescribed depth; electrically depositing a synthetic resin layer only on the etched portion of the metal by dipping the patterned metal panel in an aqueous solution containing a paint for electric deposition, the thickness of the deposited synthetic resin layer being thinner than depth of the etched portion; washing off the resist layer by a solvent; pressing a sublimation transfer sheet on the surface of the metal panel under a temperature sufficient to transfer a pattern depicted on the transfer sheet onto the surface portions deposited with the synthetic resin only.

2. The method according to claim 1, wherein an overcoat of transparent synthetic resin is further supplied over the finished surface of the metal decorative panel.

3. The method according to claim 1, wherein a paint for electric deposition includes fine particles of pigment having a negative or positive potential in water.

* * * * *

UNITED STATES PATENT AND TRADEMARK OFFICE

CERTIFICATE OF CORRECTION

PATENT NO. : 4,400,252

DATED : August 23, 1983

INVENTOR(S) : Hideru Ushijima

It is certified that error appears in the above—identified patent and that said Letters Patent is hereby corrected as shown below:

On the title page:

The Foreign Application Priority Data should read:

[30] --March 27, 1978 [JP] Japan.....35160/78--

Signed and Sealed this

*Nineteenth* Day of *March 1985*

[SEAL]

*Attest:*

DONALD J. QUIGG

*Attesting Officer* *Acting Commissioner of Patents and Trademarks*